United States Patent [19]

Suchdev

[11] Patent Number: 4,508,065

[45] Date of Patent: Apr. 2, 1985

[54] PISTON COOLING OIL DELIVERY TUBE ASSEMBLY

[75] Inventor: Jagan N. Suchdev, Woodridge, Ill.

[73] Assignee: General Motors Corporation, Detroit, Mich.

[21] Appl. No.: 476,988

[22] Filed: Mar. 21, 1983

[51] Int. Cl.[3] ..... F01P 3/08

[52] U.S. Cl. ..... 123/41.35; 123/41.36; 239/600; 92/173; 92/186

[58] Field of Search ..... 123/41.34, 41.35, 41.36; 92/173, 186; 239/600

[56] References Cited

U.S. PATENT DOCUMENTS

| | | | |
|---|---|---|---|
| 1,612,372 | 12/1926 | Gussman | 123/41.35 |
| 1,744,250 | 1/1930 | Trechsel . | |
| 1,808,380 | 6/1931 | Royal | 123/41.35 |
| 2,687,931 | 8/1954 | Flynn, Jr. | 123/41.35 |
| 2,788,773 | 4/1957 | Meurer | 123/41.35 |
| 2,800,119 | 7/1957 | Schmidl | 123/41.35 |
| 3,181,514 | 5/1965 | Druzynski | 123/41.35 |
| 3,189,010 | 6/1965 | Isley | 123/41.35 |
| 3,709,109 | 1/1973 | Howe | 123/41.35 |
| 4,010,718 | 3/1977 | Stewart | 123/41.35 |
| 4,067,307 | 1/1978 | Hofle et al. . | |
| 4,142,484 | 3/1979 | Buhl | 123/41.35 |
| 4,204,487 | 5/1980 | Jones | 123/41.35 |
| 4,206,726 | 6/1980 | Johnson, Jr. et al. . | |
| 4,377,967 | 3/1983 | Pelizzoni | 123/41.35 |

*Primary Examiner*—Ethel R. Cross

*Attorney, Agent, or Firm*—Robert J. Outland

[57] ABSTRACT

A piston cooling oil delivery tube assembly for an internal combustion engine for use in directing cooling oil from a manifold into the coolant opening of an associated piston is formed with a rigid bracket and nozzle assembly attachable to a cylinder liner and forming a nonflexible prealigned portion of the coolant delivery tube passage and a connecting tube member forming a connector portion of limited flexibility between the cylinder liner and the crankcase mounted manifold. Various other features are also disclosed.

4 Claims, 6 Drawing Figures

PISTON COOLING OIL DELIVERY TUBE ASSEMBLY

TECHNICAL FIELD

This invention relates to internal combustion engines and more particularly to piston cooling tubes for such engines. In more specific embodiments the invention pertains to piston cooling oil delivery tube assemblies for use in diesel engines and the like to deliver cooling oil from crankcase carried manifolds to inlet means within the hollow interiors of associated pistons.

BACKGROUND

In the art relating to certain types of internal combustion engines, it is well known to provide pistons having hollow interior portions which are cooled by the delivery of coolant, such as engine oil or other fluid, to the pistons' interior portions. For example, a widely used series of two stroke cycle medium speed heavy duty engines having various applications, among which is the powering of railway diesel locomotives, has utilized for decades hollow piston arrangements cooled by engine lubricating oil delivered through a piston cooling oil system. This system utilizes piston cooling tubes to carry oil from crankcase supported piston cooling oil manifolds into the bottom ends of individual replaceable cylinder liners from which the oil is directed into hollow pistons reciprocably carried in the liners.

The piston cooling tubes, or more specifically the piston cooling oil delivery tube assemblies, used in this system have for many years been made from welded tubes each formed with a U-shaped return bend and having attached thereto a manifold connecting flange and a cylinder liner connecting bracket, the latter being welded to the tube. Each tube includes a portion that extends from the bracket into the liner interior where it turns upwardly into alignment with the cylinder axis. This portion is provided at its end with a nozzle that directs a jet of cooling oil upwardly into an opening, or inlet means, provided in the piston assembly for receiving the cooling oil into a cooling chamber provided in the hollow piston interior.

The just described design of piston cooling tubes was developed to meet not only the requirement of adequate oil delivery and durability but also the necessity for removal of such tubes from the engine whenever the associated cylinder liners piston assemblies are removed for replacement or service. In addition the requirement of reasonable manufacturing cost also required consideration.

Recognizing that the design has provided satisfactory service in commercial operations over a period of many years, it was noted from time to time that certain characteristics of the design or its manufacture resulted in manufacturing and operational problems. For example, the bracket by which the tube assembly is attached to the cylinder liner was formed as a rough forging that required extensive machining in manufacture. Variations in the forging dimensions sometimes caused difficulties in holding the required tolerances, causing additional manufacturing and rework costs. The tube itself was required to be formed by bending in several steps, partly before and partly after the attachment of the bracket by welding. The bending and welding processes were manually accomplished and time consuming, with resulting variations that required the individual alignment of each assembly at installation. In addition, the nozzle was variously formed separately and attached to the tube or formed as a part thereof causing, in either case, certain manufacturing difficulties.

Because of dimensional variations between the mounting location of the piston cooling tube on the oil manifold and that on its respective cylinder liner, caused by manufacturing tolerances and by operational conditions such as temperature variations and possible limited relative motion of the two components, it is necessary that the piston cooling tube be formed with a reasonable degree of flexibility between the manifold and cylinder liner attachment locations. This was accomplished in part by the return bend configuration of the tube and by selection of a tube size and thickness capable of limited flexing and also of maintaining its shape in normal handling and operation. This flexibility, however, resulted in the possibility of bending from rough handling and required that, upon the original installation or reinstallation of a cooling tube in an engine, the nozzle end of the tube be checked with an aiming gauge and adjusted if necessary to obtain the proper alignment of the nozzle opening with the piston cooling inlet so that the oil jet would be properly directed into the cooling oil inlet during engine operation.

Because of these and other problems it was desired to provide an improved design of piston cooling tube which would overcome some of the problems of the previous design and still provide the operational characteristics required.

SUMMARY OF THE INVENTION

The present invention provides a piston cooling oil delivery tube assembly having the required operational characteristics combined with a number of significant improvements which provide advantages in both manufacturing and use as compared to the prior design.

One feature of the invention is that the portion of the tube assembly extending from the liner-attached bracket to the end of the nozzle is made rigid to avoid deformation in service. Thus attachment of the bracket to the cylinder liner in a predetermined fixed position provides the required alignment of the nozzle with the piston cooling inlet without the need for gaging or subsequent adjustment of the nozzle position.

Another feature is that the bracket is formed by investment casting to include a portion of the cooling oil passage within the casting. This method of manufacture requires a minimum of machining and limits assembly variations, thereby reducing cost and scrap losses.

Still another feature is that the oil passage extends through three distinct elements of the assembly, a tube member, the connecting bracket and a nozzle mounted in the bracket. These elements are assembled to one another by brazing in a fixture. The separate nozzle allows machining to accurate dimensions prior to assembly. Mounting of the nozzle directly in the bracket provides the rigid assembly required to eliminate subsequent gaging and adjustment.

The tube member extends between the bracket and the manifold, providing limited flexibility between these mounting locations as in the previous design. Brazing of the separate elements together in an assembly fixture provides a high degree of accuracy with lower stresses in the tube than caused by the previous welding operation. Further, the assembly operation may be partially automated to reduce manufacturing costs.

These and other features and advantages of the invention will be more fully understood from the following description of certain preferred embodiments taken together with the accompanying drawings.

BRIEF DRAWING DESCRIPTION

DETAILED DESCRIPTION

Figure 1:
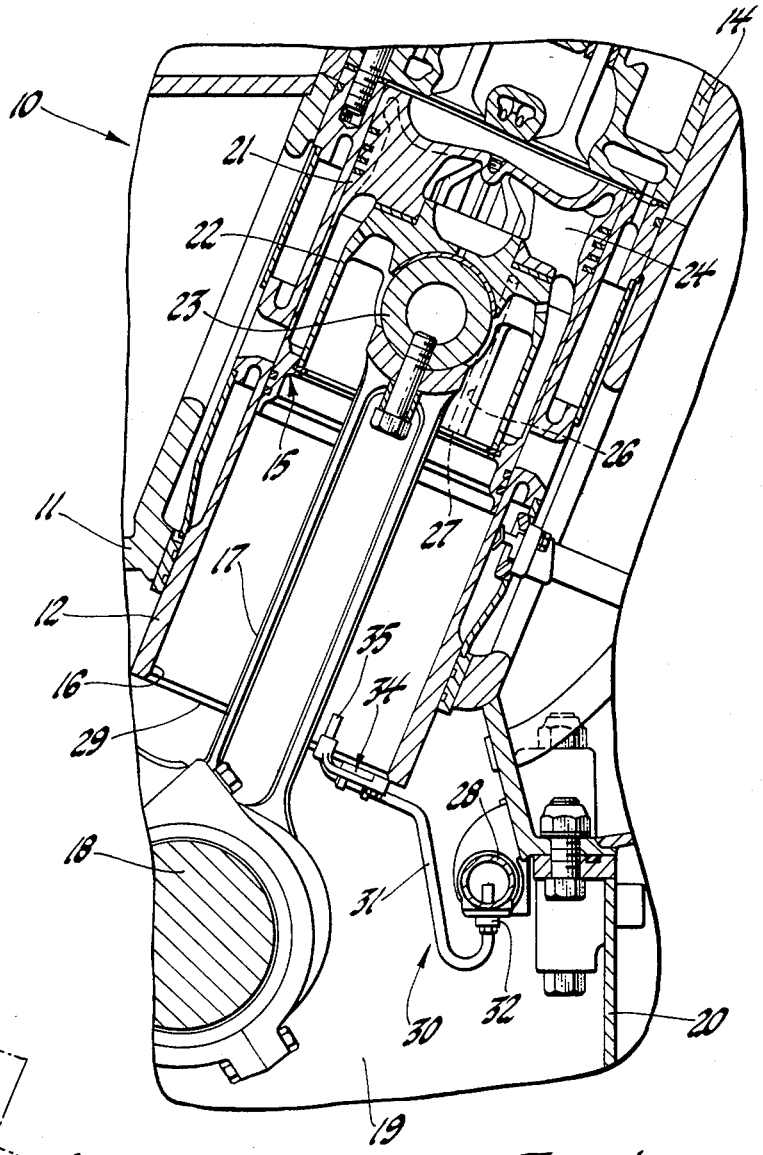
FIG. 1 is a cross-sectional view of a portion of a V-type two stroke cycle diesel internal combustion engine having piston cooling oil delivery tube assemblies in accordance with the invention.

Referring now to the drawings in detail, numeral 10 generally indicates a V-type heavy duty medium speed two stroke cycle diesel engine of a type used in railway diesel locomotives and other applications. Engine 10 has a fabricated crankcase 11 in which are secured a plurality of removable power assemblies, each including a cylinder liner 12 having a cylinder head 14 secured to and closing the upper end thereof and a piston assembly 15 disposed for reciprocation within a bore 16 of the cylinder liner. Piston assembly 15 is attached by a connecting rod 17 with a crankshaft 18 carried for rotation in a crank chamber 19 formed below the cylinder liners in a lower part of the crankcase and a supporting oil pan 20.

The piston assembly 15 in this engine has two main components: a hollow outer piston 21 and an inner carrier 22. The piston is rotatably secured on the carrier, which is pivotally attached to a piston pin 23 fastened to the upper end of the connecting rod.

Between the outer piston and inner carrier, a coolant chamber 24 is provided in which cooling oil is received for the purpose of cooling the walls of the piston. Cooling oil is admitted to the coolant chamber through a coolant inlet passage 26 extending through a wall of the carrier 22 and opening at 27, near the bottom of the carrier, to the interior of the cylinder liner at a location offset radially and longitudinally to one side of the cylinder axis. Suitable means, such as drain openings,. not shown, are also provided for allowing an outflow of cooling oil from the coolant chamber 24 back to the engine oil pan in order to permit a continuing flow of oil through the chamber to carry away heat from the piston walls.

The engine is further provided with a piston cooling system which utilizes engine lubricating oil that is filtered and cooled by auxiliary means, not shown. The oil is forced by a piston cooling pump, also not shown, into a pair of piston cooling oil manifolds 28 carried by the crankcase and extending longitudinally along the sides of the crank chamber at locations slightly below the lower ends 29 of the removable cylinder liners 12. In order to deliver the oil from the manifolds 28 to the openings 27 of the piston coolant inlet passages 26 and thence into the coolant chambers 24, the engine is provided at each cylinder location with a piston cooling oil delivery tube assembly, commonly referred to as a piston cooling tube and generally indicated by numeral 30.

Figure 2:
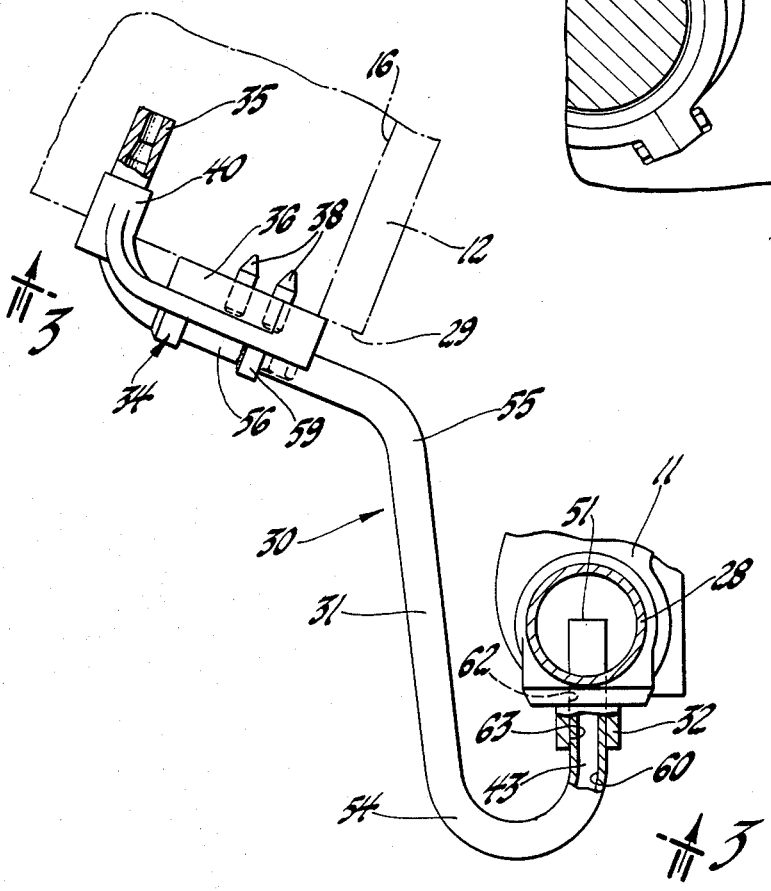
FIG. 2 is a side view of one of the piston cooling tube assemblies in the engine of FIG. 1 viewed in the direction of the engine longitudinal axis.
Figure 3:
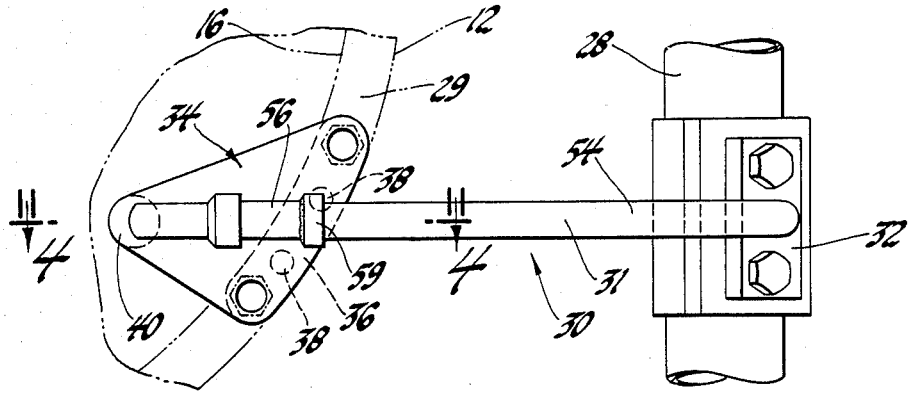
FIG. 3 is a bottom plan view of the assembly of FIG. 2 viewed from the plane of the line 3—3 in the direction of the axis of its associated cylinder.
Figure 4:
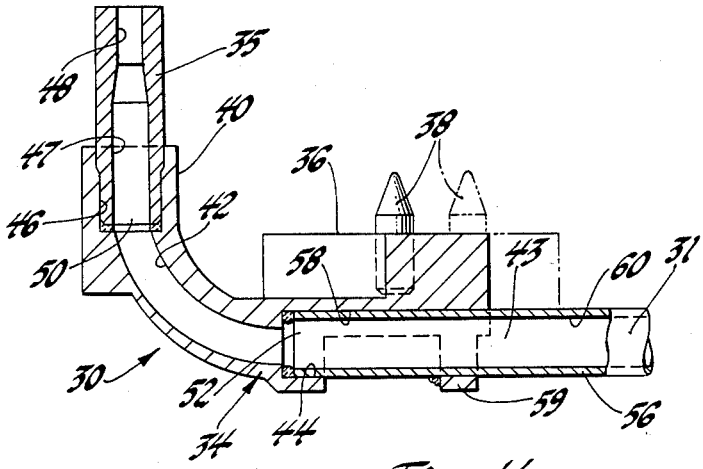
FIG. 4 is a cross-sectional view of a portion of the assembly from the plane indicated by the line 4—4 of FIG. 3.

Assembly 30, as is best shown in FIGS. 2–4, is an integral assembly of several elements including a formed tube 31, a flange 32, a connector bracket 34 and a nozzle 35.

The connector bracket 34 is preferably formed by investment casting to relatively close dimensional tolerances that require a minimum of machining. The cast part includes a mounting boss 36 which is secured against the lower end 29 of the associated cylinder liner in a position fixed by a pair of dowel pins 38 secured in the boss 36 and extending into suitable openings machined into the lower end of the liner. The bracket further includes an upwardly curving end portion 40 internally defining a curved passage portion 42 which forms a part of a cooling oil delivery passage 43. At opposite ends of the curved passage portion 42 there are formed mounting recesses 44, 46.

The nozzle 35 is formed as a separately premachined accurately dimensioned rigid tubular part having an internal passage 47 smoothly diminishing toward a cylindrical outlet portion 48 of predetermined diameter at the outer end. The nozzle element is relatively short and the upstream end 50 is secured within the mounting recess 46 at the outer end of the connector bracket curved portion.

The tube 31 includes opposite ends 51, 52 between which are a U-shaped return bend 54 relatively close to the one end 51 and a somewhat smaller bend 55 spaced from but closer to the other end 52. A straight portion 56 between the bend 55 and the end 52 extends along a recess 58 and through a support strap 59 of the bracket 34 into the mounting recess 44 where it is secured to connect the internal passage portion 60 of the tube with the curved passage portion 42 of the connector bracket 34. The opposite end 51 of the tube extends into the cooling oil manifold 28 through a suitable opening 62 provided along a lower side thereof. The flange 32, secured in any suitable manner to the tube near the end 51, is in turn fastened to the manifold to maintain the piston cooling tube in assembly therewith.

It may be noted that the tube, bracket and nozzle of the embodiment of FIGS. 2–4 are formed and assembled such that their internal passage portions 60, 42, 47 respectively lie in a common lateral plane which extends, when installed, normal to the engine's longitudinal axis. This feature of the design is not a requirement of the invention, but may be varied to meet the needs of differing engine applications.

In the preferred embodiment, the flange 32 is secured to the tube by rolling the tube wall into engagement with the periphery of an opening 63 in the flange through which the tube extends. The other end 52 of the tube and the upstream end 50 of the nozzle are connected in their respective recesses 44, 46 of the connector bracket, preferably by torch brazing in a fixture using preinstalled brazing rings to provide the retaining material.

When so assembled, the piston cooling oil delivery tube assembly 30 provides limited flexibility to accommodate dimensional variations in vibration between the cylinder liner and the crankcase-carried cooling oil manifold through the flexibility of the tube member as in the previous design. However the assembly further provides a rigid passage portion extending from and through the connector bracket 34 and the nozzle 35 which, when assembled to the cylinder liner, is accurately aligned to avoid the need for gaging and adjustment of the nozzle direction after assembly. The nozzle member and the attached bracket member are both made sufficiently stiff so as not to be subject to bending during handling, whereby the avoidance of gaging and adjustment upon subsequent reassembly is maintained.

Figure 5:
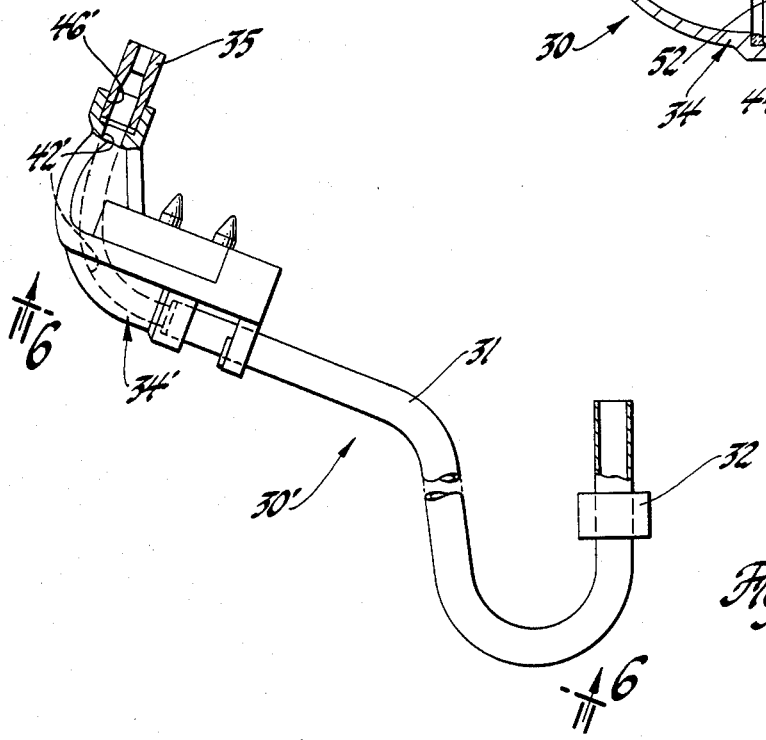
FIG. 5 is a side view of an alternative embodiment of piston cooling tube in accordance with the invention.
Figure 6:
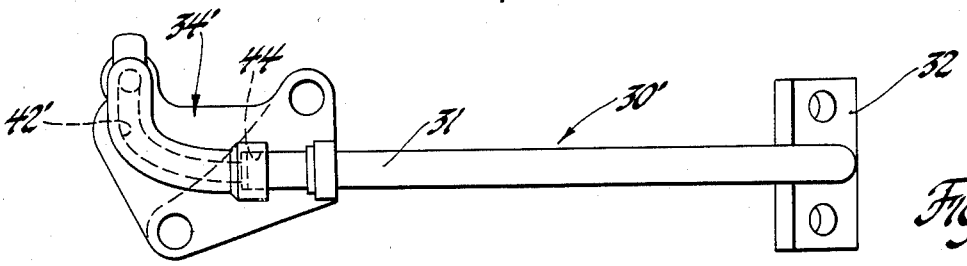
FIG. 6 is a bottom plan view of the piston cooling tube from the plane of line 6—6 of FIG. 5.

Referring now to FIGS. 5 and 6, there is shown an alternative embodiment of piston cooling tube formed in accordance with the invention. The embodiment of FIGS. 5 and 6 differs only in the form of the connector bracket from the embodiment of FIGS. 2–4. Accordingly like reference numerals have been used to identify like parts, while primed numerals signify modified parts.

The connector bracket 34' of FIGS. 5 and 6 differs from that previously described in that the recess 46' which supports the nozzle 35 is longitudinally offset from the lateral plane of the recess 44 and the associated tube 31 connected therein. Thus the interior curved passage portion 42' within the bracket 34' extends in a nonplanar curving path between the two recesses, forming a somewhat more difficult casting operation but serving functionally the same purpose as the passage in the earlier described embodiment. The reason for this difference in construction is merely to position the nozzle in the slightly different location required for use in an engine model having somewhat different dimensional characteristics.

While the invention has been described by reference to certain embodiments chosen for purposes of illustration, it should be understood that numerous changes could be made within the spirit and scope of the inventive concepts described. Accordingly it is intended that the invention not be limited to the described embodiments but that it have the full scope permitted by the language of the following claims.

The embodiments of the invention in which an exclusive property or privilege is claimed are defined as follows:

1. A piston cooling oil delivery tube assembly for an internal combustion engine having a crankcase supporting a removable cylinder liner with a hollow piston carried for reciprocation therein and having inlet means to receive cooling oil within the hollow piston, an oil distribution manifold carried in the crankcase near an open end of the cylinder liner and connected with a source of pressurized cooling oil, wherein said tube assembly includes passage defining means including a tube having two ends, one connectable with said manifold, and a nozzle at the other of said ends, and support means including a bracket attached near the nozzle end of the tube for fixing said tube to the cylinder liner with the nozzle in alignment with the piston cooling oil inlet means and a flange near said one end of the tube for securing said one end to said manifold, the portion of said tube extending between said bracket and said flange including a return bend and having a length sufficient to permit limited resilient flexure to accommodate minor relative movement and dimensional variations between the manifold and cylinder mounting locations, and the improvement wherein said bracket forms a portion of said passage defining means having a curved passage portion connected between said tube other end and said nozzle, said tube and nozzle being separately formed and individually connected with said bracket, said nozzle being preformed as a short stiff member and assembled to said bracket to provide, at assembly, a fixed alignment with the piston cooling oil inlet means not requiring gaging or adjustment of the nozzle position after assembly, while said tube maintains limited flexibility between the bracket and flange.

2. A piston cooling oil delivery tube assembly for an internal combustion engine, said tube assembly comprising a preformed tube having opposite ends with an intermediate bend, said tube extending for a length permitting limited resilient flexure between said opposite ends, a flange fixed near one of said tube ends to connect it with a source of cooling oil fixed in a crankcase of such engine, a connector bracket fixed near the other of said tube ends and connectable with a cylinder liner removably carried in said crankcase, said cylinder liner having a bore containing a reciprocable piston therein, said bracket having a curved passage formed therein and extending from said tube other end to a nozzle receiving portion projecting into said bore of the cylinder liner when attached thereto, and a rigid nozzle member fixed to said nozzle receiving portion of the bracket and connecting with said curved passage, said nozzle being aimed to direct, toward a coolant inlet of said piston, a stream of cooling oil delivered from said source through said tube assembly, said bracket and said nozzle forming a rigid structure having means for assembly to said liner in a predetermined fixed position to provide a nonadjustable flow direction of said oil stream toward said piston, and said tube providing limited flexibility of movement between said flange and bracket to allow for dimensional variations and movements between said crankcase carried oil source and said cylinder liner.

3. A tube assembly as defined in claim 2 wherein said bracket is formed by investment casting to incorporate said curved passage and recessed seats are provided at each end of said passage to receive adjacent ends of said tube and said nozzle.

4. A tube assembly as defined in claim 3 wherein said tube and nozzle are secured to said bracket by brazing.

* * * * *